United States Patent [19]

Sheshtawy

[11] 4,273,372

[45] Jun. 16, 1981

[54] APPARATUS FOR USE IN LOWERING CASING STRINGS

[75] Inventor: Adel A. Sheshtawy, Norman, Okla.

[73] Assignee: Standard Oil Company (Indiana), Chicago, Ill.

[21] Appl. No.: 101,603

[22] Filed: Dec. 10, 1979

Related U.S. Application Data

[63] Continuation of Ser. No. 942,243, Sep. 14, 1978, abandoned.

[51] Int. Cl.[3] ..... E21B 31/20

[52] U.S. Cl. ..... 294/86.15; 166/212; 166/215; 294/86.17; 294/86.25; 294/96

[58] Field of Search ..... 294/86.14, 86.15, 86.17, 294/86.19, 86.22, 86.24, 86.25, 94, 96, 102 A; 166/212, 215, 217; 285/140, 141

[56] References Cited

U.S. PATENT DOCUMENTS

| | | | |
|---|---|---|---|
| 1,616,978 | 2/1927 | MacClatchie | 166/217 X |
| 1,815,462 | 7/1931 | Denney | 294/86.15 |
| 2,435,899 | 2/1948 | Page | 166/212 |
| 2,815,080 | 12/1957 | Long | 166/212 X |
| 2,874,784 | 2/1959 | Baker et al. | 166/212 |
| 3,278,220 | 10/1966 | Wilson | 294/86.25 |
| 3,528,500 | 9/1970 | Brown | 166/212 |

*Primary Examiner*—Johnny D. Cherry
*Attorney, Agent, or Firm*—John D. Gassett

[57] ABSTRACT

An apparatus for use in lowering casing strings or other parts from a floating unit to a subsea well which includes an expansion-type casing running tool employing extendible latches that have left-handed threads cut on their exterior for engagement with similar threads on the inside of the casing which is to be lowered. Tapered blocks are spring loaded for expanding the dogs into position and hydraulic pressure is used to retract the blocks thus disengaging the running tool from the equipment just lowered. If disengagement of the latches is not accomplished, the running tool can be removed from the casing by left-handed rotation.

7 Claims, 9 Drawing Figures

APPARATUS FOR USE IN LOWERING CASING STRINGS

This is a continuation of application Ser. No. 942,243, filed Sept. 14, 1978, now abandoned.

BACKGROUND OF THE INVENTION

1. Field of the Invention

This invention relates in general to offshore drilling and construction operations and more particularly to an improved system for lowering tubular members and other equipment through a restricted opening at or below the sea bottom. On land, when a well is drilled for the production of oil and gas, the casing is lowered through the hole to seal the side of the hole, for example. This is not too complicated an operation because the drilling rig is adjacent the hole. However, in lowering operations involving a floating drilling vessel in water which may be several hundred or more feet in depth, the lowering operation becomes more complicated. The casing string (or other equipment) is usually lowered or run by attaching a running tool to the upper end of the casing string and having that tool attached to a string of small diameter pipe which can be called the handling string. The casing is then lowered into the wellbore by the lowering of the handling string. When the casing has reached its lower objective, the running tool is released and is retrieved at the surface by pulling the small diameter pipe.

2. Prior Art—Present System

At the present time, most running apparatus used in offshore operations is based on a left-hand threaded member attached to the lower end of a handling string fitted with a right-hand connection (normal tool joints) between sections of the handling string. As the casing string and/or other equipment reaches the desired position below sea level, the running tool can be released by rotation of the handling string to the right which disconnects the running tool without the risk of disconnecting the various joints of the handling string.

The increase in offshore drilling and construction activities from floating units resulting in displacement of the floating unit from directly above the wellbore axis and difficulties in placing the connecting point of the running tool in neutral axial loading due to the heaving of the vessel dictated the need for a more efficient subsea running tool. The above-mentioned vessel movements increase the torque required to disengage presently designed running tools from the subsea installation. In deep waters, the high torque required to disengage the running apparatus may result in damage of the connecting threads or twisting the handling string to failure. This is especially true when the tubular member to be run has a larger diameter than the handling string which is usually the case.

Various attempts have heretofore been made to overcome these limitations of existing equipment. In one prior art system, a running tool or apparatus contains a handling string swivel mounted to the tool body to accommodate displacement of the floating unit from above the wellbore axis in misalignment due to a sloping seafloor.

The foregoing type of running apparatus is considered to be less than satisfactory from a number of standpoints. First, the swivel permits only a limited degree of misalignment. Secondly, the torque transmitted through an inclined handling string will generate higher friction between the threaded elements. Third, the amount of the handling string inclination or misalignment becomes limited if the seat point is a few feet inside the wellbore or restricted opening.

In accordance with a second prior art system, a running tool with central torque actuating locking rams is used to reduce the torque required for disengaging the running tool from relatively larger diameter pipes. This type of running apparatus has not completely overcome the limitations set out above.

A prior art search revealed no art which showed the present invention. Four patents that were set forth in the report of that search had some but not all of the features of the present invention. These prior art patents are:

1. U.S. Pat. No. 3,222,088, J. A. Haeber, inventor, issued Dec. 7, 1965, "Wellhead Connector With Diagonally Directed Latches." This patent discloses the use of sliding blocks having grooved surfaces that mesh with grooves on the outer surface of the inner member to which it is to be attached. The grooves are described as being continuous or interrupted circumferential grooves. Attempting to turn one of these members with respect to the other could not unthread the tool.
2. U.S. Pat. No. 3,321,217, A. G. Ahlstone, inventor, issued May 23, 1967, "Coupling Apparatus for Wellheads, and the Like." This shows a latching device similar to the one in the Haeber patent supra.
3. U.S. Pat. No. 3,456,729, J. M. Harwell, Jr., inventor, issued July 22, 1969, "Stab-In Conduit Couplings." This describes a conduit coupling that consists of an outer slotted member that has internal left-hand threads cut in it which match with similar threads on the outside surface of the male member. Engagement is made by forcing the inner member downward and springing the slotted portion outward to permit the threads to pass each other until full engagement is acquired. No latching dogs are involved.
4. U.S. Pat. No. 3,675,713, Bruce J. Watkins, inventor, issued July 11, 1972, "Method and Apparatus for Separating Subsea Well Conduit Coupling From a Remote Floating Vessel." This describes a connector very similar to the one Haeber reference described above and uses a series of hydraulic cylinders mounted in a manner to force the coupling apart in the event it jams due to misalignment and cannot be separated after the locking dogs are withdrawn. There is no provision for separating by unscrewing in event the locking dogs cannot be disengaged.

BRIEF DESCRIPTION OF THE INVENTION

This invention concerns a running tool. A running tool is an apparatus connected to the lower end of a handling string. The running tool can releasably engage a string of casing or other equipment which is desired to be lowered from a floating vessel to a location at or below the subsea floor. The tool includes a cylindrical housing having slots or openings through the walls of the housing. Tapered blocks are spring loaded for expanding latching dogs through the openings into position to engage the inner wall of the casing being run. The outer ends of the dogs are grooved to form left-handed threads. Matching left-handed threads are provided on the interior of the string of casing for the dogs to engage.

After the casing has been engaged by the latching dogs, it is then lowered by the handling string into position. Once the casing is in position, hydraulic pressure is used to retract the blocks and disengage the dogs from the internal threads of the casing. If disengagement of the threads is not accomplished, the running tool can be removed from the casing by left-hand rotation. After the running tool is disengaged from the casing, the handling string is lifted to retrieve the running tool.

A better understanding of the invention may be had from the following description taken in conjunction with the drawings.

DRAWINGS

DETAILED DESCRIPTION OF THE PREFERRED EMBODIMENT

Figure 1:
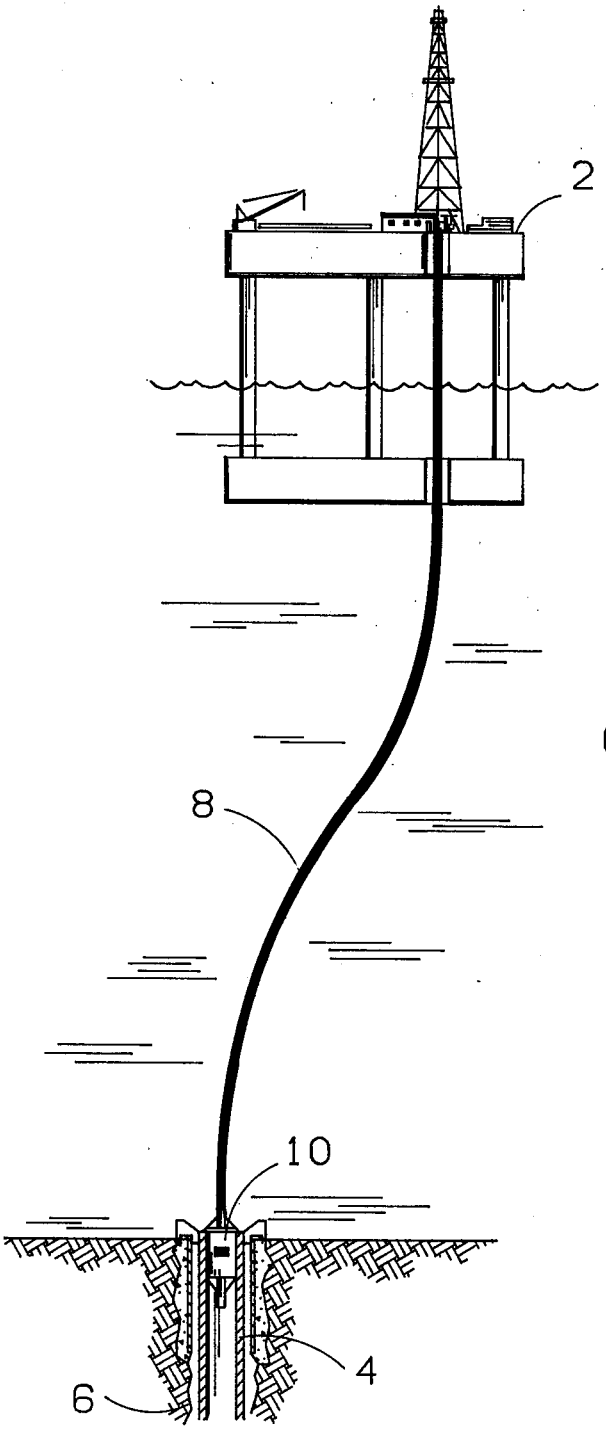
FIG. 1 is a somewhat diagrammatic view of an underwater wellbore site with a floating unit and a curved handling string including the running tool.

Referring now to the drawings and particularly to FIG. 1, there is shown a floating drilling unit 2 running a casing string 4 into a partially drilled subsea wellbore 6. The casing string 4 is run, or lowered, with the handling string 8 and running apparatus or tool 10. In operation, the casing string 4 is made up in sections and lowered from the derrick of the drilling unit 2 in a known manner until a sufficient length of the casing is suspended below the drilling unit. The running tool 10 is then connected to the top of casing 4 and the handling string 8 is connected to the running tool 10. The running tool 10 is lowered by lowering the handling string 8 from the drilling unit 2 in a known manner. Means for guiding casing 4 into hole 6 are not shown inasmuch as such means are well known. The handling string 8 is then lowered until the casing string 4 is in the desired position. At this point, the running tool 10 is released from the casing 4 and is retrieved to the drilling unit 2 by hauling in or pulling up handling string 8. Handling string 8 can be any small diameter pipe string. The quick release running tool of the present invention may be used in operations related to both offshore drilling or offshore construction to run and seat various parts below sea level.

Figure 2:
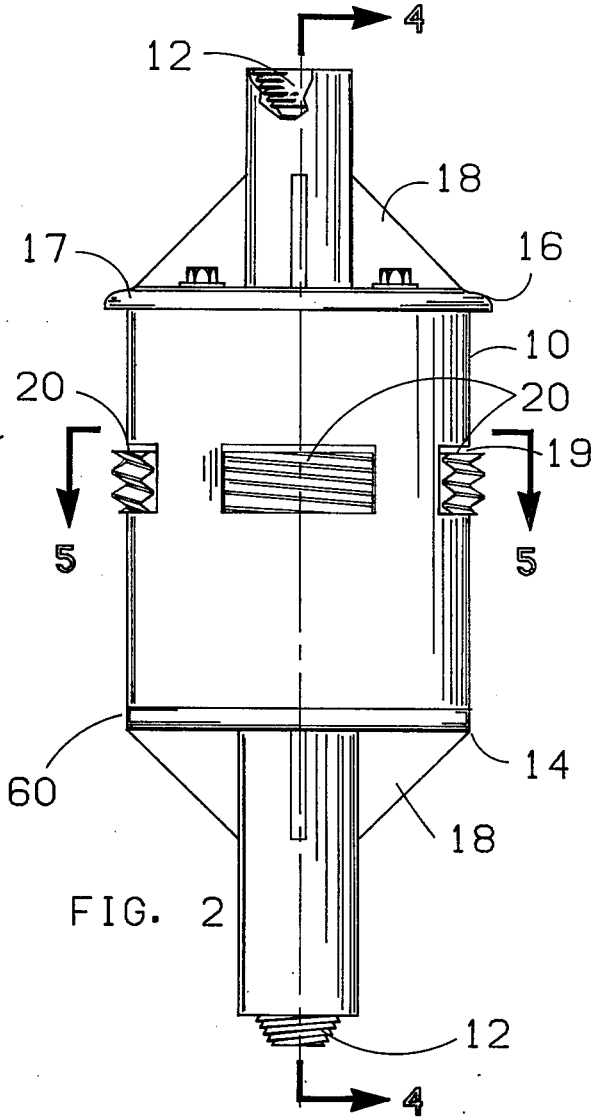
FIG. 2 is a side elevation view of the quick release running tool.
Figure 3:
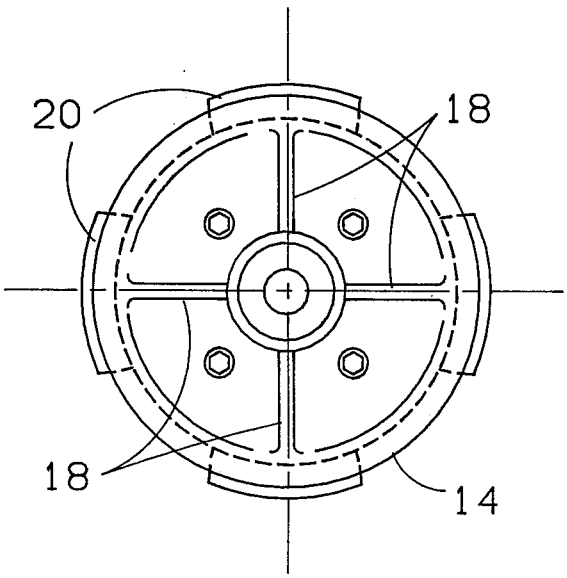
FIG. 3 is a plan view of the quick release running tool shown in FIG. 2.
Figure 9:
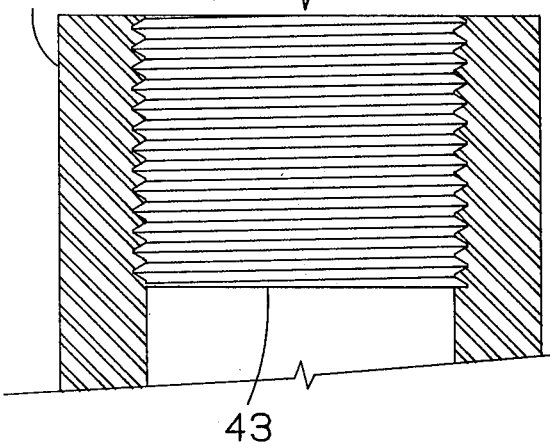
FIG. 9 shows connecting threads in the upper end ŏf a casing which is to be run.

The quick release running tool 10 of the present invention is illustrated in detail in FIGS. 2 and 3. The tool 10 includes threaded collars 12 at the top and bottom which are adapted for connection to the handling string 8. It is to be noted that the lower threaded collar is not essential. The running tool also includes a central cylindrical housing 14 which is approximately equivalent in diameter to the casing diameter to be run. Housing 14 has upper end member 17 threadedly connected thereto for ease of assembly. End member 17 has shoulder 16 which is normally slightly larger than the casing diameter to be handled using the running tool. A conical portion 18 is tapered from the cylindrical housing 14 to the threaded collars 12. Segment elements 20 are fitted radially in the radial slots 19 in housing 14 and are freely movable inwardly or outwardly in their respective slots or openings in the housing. A groove 60 is provided in the lower part of housing 14 and is normally equipped with a sealing element O-ring or like to seal with the inside of the casing string which is to be attached and handled by the quick release running tool. Segment elements 20 are provided with left-hand coarse threads on the exterior ends thereof which, as will be seen, are used to engage corresponding threads 43 on the interior of the casing 4 being run as shown in FIG. 9.

Figure 4:
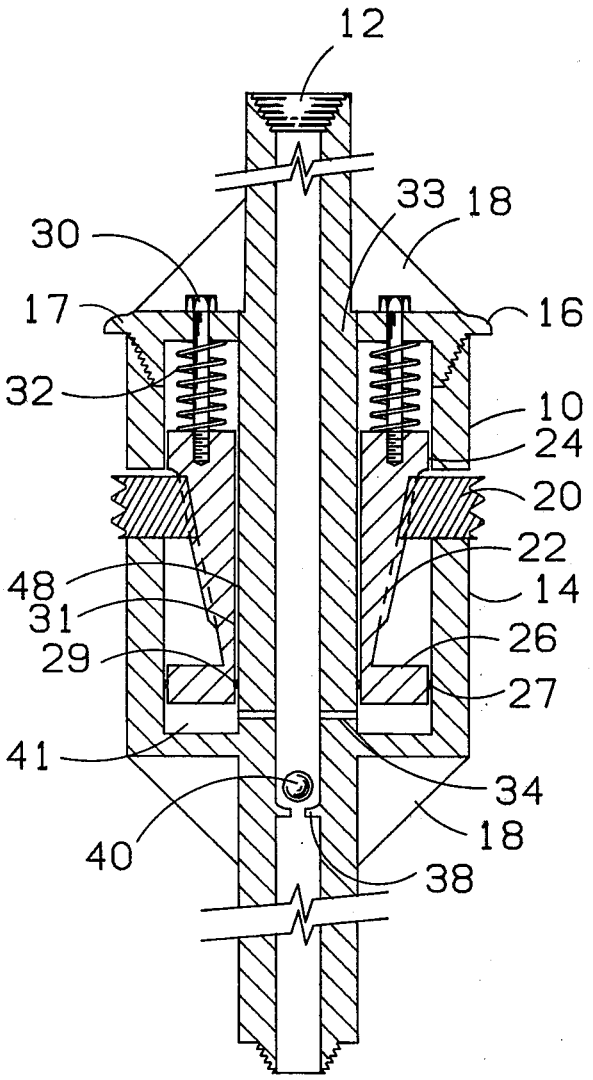
FIG. 4 is a section view of a quick release running tool shown in FIG. 2 taken generally along the line 4—4.

Means will now be discussed which illustrate how segment elements 20 are moved radially. For this, attention is directed to FIG. 4. A conical element 22 having a base end connected to top flange 24 and an apex end connected to bottom flange 26 is provided within cylindrical housing 14. The diameter of bottom flange 26 is approximately equal to the inside diameter of cylindrical housing 14. A seal 27 is provided between flange 26 and the interior of housing 14. A male dovetail 28 is machined vertically on the surface of the conical element 22. A mating female dovetail arrangement exists in the inside end of the segment elements 20. Conical element 22 has a vertical passage 31 and slideably fits over hollow guidepost 33. A seal 29 is provided between the interior of conical element 22 and the exterior of hollow guidepost 33. Bottom flange 26 then becomes a piston. The male dovetail arrangement 28 on the conical element terminates at a distance from the top of the lower flange 26 to aid in assembling the apparatus.

Conical element 22 is urged downwardly by springs 32 which are held in position by bolts 30 which extend through the top of the shoulder 16 and can be threadedly connected to conical element 22 but are not attached to upper end member 17.

Conical element 22 can be raised by hydraulic force. The portion of the apparatus permitting this will now be discussed. A passage 34 is provided between the interior of hollow guidepost 33 and the space 41 beneath lower flange 26. A seat 38 is provided in the interior of hollow guidepost 33 at a point below passage 34. Hollow guidepost 33 is connected to handling string 8. When it is desired to raise the conical element 22, a ball 40 is dropped in handling string 8 and seats in seat 38. Hydraulic pressure is applied through the interior of the hollow guidepost 33 from the surface through handling string 8, through passage 34 to space 41 to force the conical element 22 upwardly. Due to the dovetail arrangement, this will retract the segment elements 20 and disconnect them from whatever was being lowered.

Figure 7:
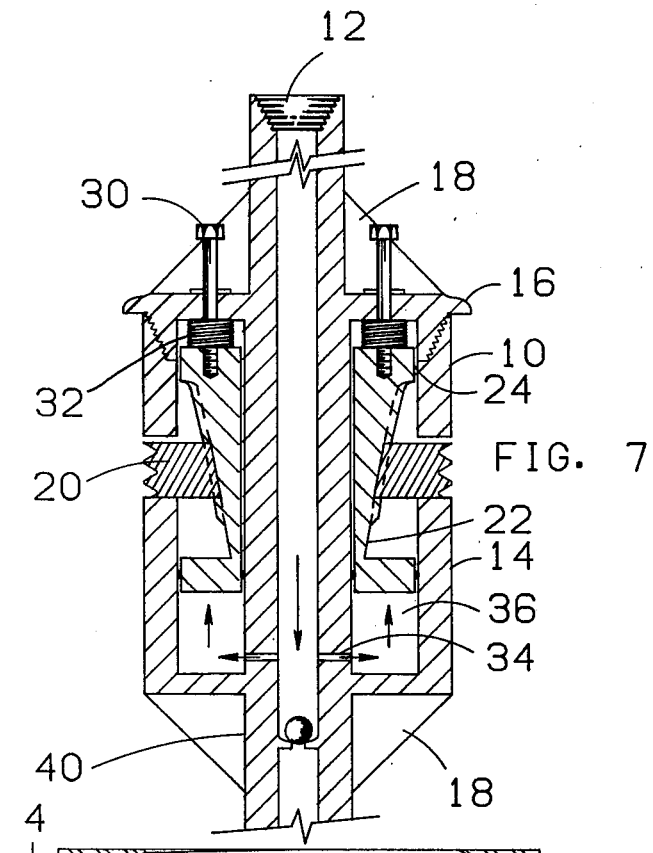
FIG. 7 is a section view with the apparatus in closed position.
Figure 8:
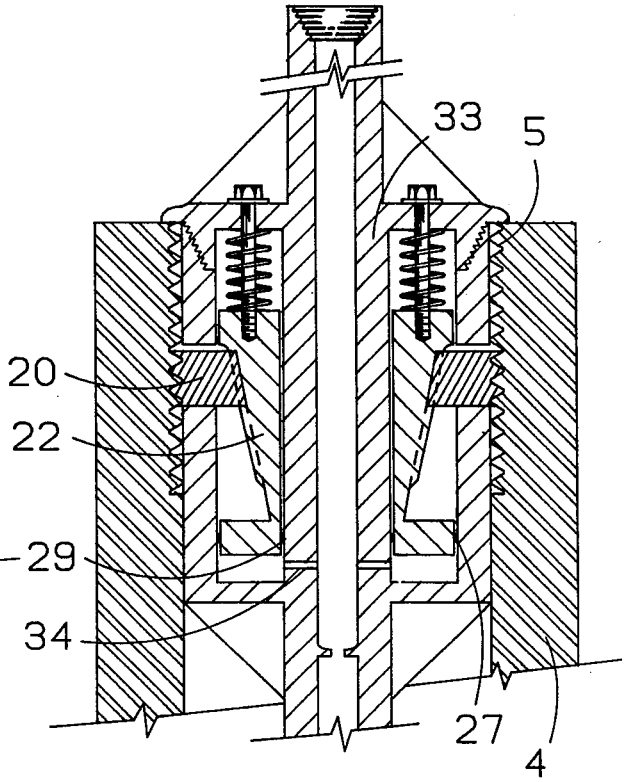
FIG. 8 is a section view with the apparatus in open position attached to apparatus to be lowered; and ;p

Attention is directed to FIG. 7 to further explain the use of the quick release running tool 10 when it is desired to lower a string of casing. Conical element 22 is moved to the upper position either by pulling on indicator bolts 30 or applying pressure below the lower flange 26 through the handling string and opening 34. As the conical element 22 moves upward, the segment elements 20 move inward and the apparatus slides inside the casing or the opening in the part to be lowered. As the shoulder 16 reaches the upper part 5 of the casing and pressure is released, the springs 32 will push the conical element 22 to the lower position and consequently the segment elements extend outwardly and engage the pulling threads 43 on casing string 4 shown in FIG. 8. Segment elements 20 are of course aligned properly with the threads 43 before pressure is released permitting the springs to cause the elements 20 to expand outwardly into the threads 43. Now, with the quick release running tool attached firmly to the upper end of casing 4 (or other equipment to be run), additional length of the handling string 8 is added in a conventional manner until the part of casing 4 reaches the desired position at or below the seafloor. At this point, the handling string is stopped and a tripping ball 40 is dropped to seat and seal the inside of the handling string at the seat 38. With the application of pressure through the handling string and openings or passage 34, the conical element 22 will move upwardly retracting the segments 20 and quickly release the running tool which then can be withdrawn to the surface. If disengagement of the latches cannot be obtained by movement of conical member 22, the running tool can be removed from the casing by left-hand rotation.

Figure 6:
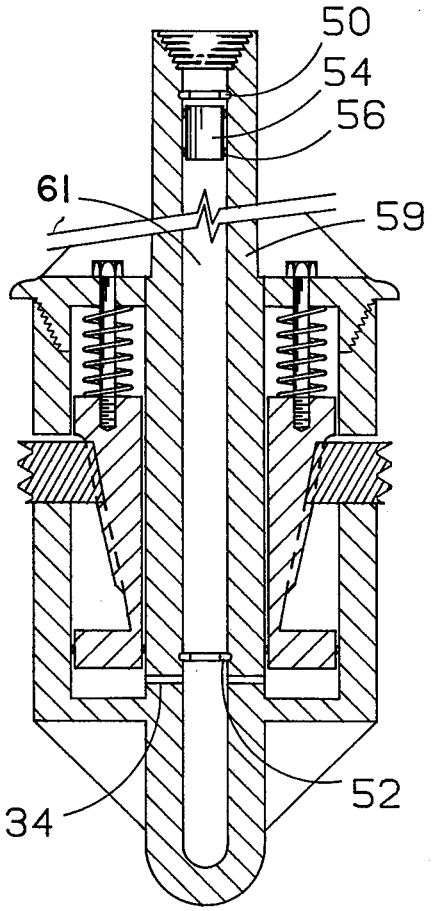
FIG. 6 is a section view of other arrangements in a quick release running tool illustrating a closed hydraulic system for operating the tool.
Figure 5:
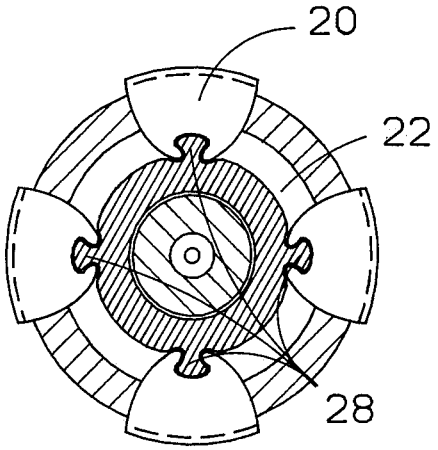
FIG. 5 is a section view of the quick release running apparatus shown in FIG. 2 taken generally along the section line 5—5.

FIG. 6 shows another embodiment for operating the quick release running tool if the handling string can be run with its lower end sealed off. A piston 54 is provided within the interior passage 61 of the hollow guidepost 59 and is provided with seal rings 56 and is free to move between the stop rings 50 and 52 within the hollow portion of the guidepost 59. Guidepost 59 is closed at the bottom. The space below piston 54 is filled with hydraulic oil and will prevent clogging of openings 34 with any impurities which might exist in the sea water and will assure longer service life of the apparatus. Pressure is applied through the handling string 8 in a manner similar to that described above in regard to FIG. 4 for releasing the tool.

While the above invention disclosure has been described in detail, it is possible to make various modifications therefrom without departing from the spirit or scope of the invention.

What is claimed is:

1. A quick release running tool for offshore operations comprising:

a housing defining a cylinder therein and having radial openings in the walls of said housing;

a hollow guidepost running through said housing and forming an annulus between the exterior of the post and the interior of the housing;

a conical element having a base end and an apex end within said annulus and mounted about said hollow guidepost and movable between an upper position and a lower position, said conical element having a bottom flange at the apex end and sealingly engaging the walls of said annulus;

means urging said conical element in the direction of said flange toward said lower position;

a passage connecting the interior of said hollow guidepost with the annulus below said flange;

segmented elements fitted radially in the said openings; and means connecting said segmented elements to the outer wall of said conical element in a longitudinal sliding relationship.

2. A quick release tool as defined in claim 1 including:

a threaded collar means for attaching the upper end of said housing to a handling string;

the outer ends of said segmented elements being cut to form left-handed threads;

means for closing the lower end of the hollow guidepost below said passage.

3. A quick release running tool as defined in claim 1 including:

means closing the bottom of the interior of said hollow guidepost;

an upper stop and a lower stop within said hollow guidepost and both above said passage;

a sealing plug slideably mounted between said upper and lower stops within said hollow guidepost; and hydraulic fluid beneath said plug filling said hollow guidepost and the portion beneath said flange of said annulus in communication with said hollow guidepost.

4. A quick release tool as defined in claim 1 in which said means connecting said segmented elements to said conical element include a male dovetail arrangement machined longitudinally on the exterior surface of said conical element, said segmented elements having a female dovetail arrangement equivalent in size to the male dovetail arrangement on said conical element surface with both dovetail arrangements engaging each other.

5. A quick release running tool as defined in claim 4 wherein said male dovetail arrangement on the surface of the conical element is terminated at a distance from the top of the bottom flange of the conical element equivalent to the thickness of the segmented elements engaged with the conical element by means of the dovetail arrangement.

6. A quick release running tool as defined in claims 1, 2, 3, 4, or 5 including a plurality of springs mounted on top of the base end of said conical element urging it downwardly.

7. A quick release running tool for offshore operations comprising:

a hollow housing having radial openings in the walls thereof;

a hollow guidepost running through said housing and forming an annulus between the exterior of the post and the interior of the housing;

segmented elements fitted radially in said openings;

means connected to said segmented elements to radially extend or retract said elements beyond or within the outer wall of said housing responsive to fluid pressure within said hollow guidepost;

the exterior end of each element having threads thereon aligned with the threads on the other exterior ends forming a discontinuous screw thread to enable release of said elements by rotation of the tool in event said means fail to retract said elements.

* * * * *